US011192133B2

(12) United States Patent
Renquist

(10) Patent No.: US 11,192,133 B2
(45) Date of Patent: Dec. 7, 2021

(54) BOUNCE REDUCING COVER FOR A SPRINKLER

(71) Applicant: The Toro Company, Bloomington, MN (US)

(72) Inventor: Steven C. Renquist, Norco, CA (US)

(73) Assignee: The Toro Company, Bloomington, MN (US)

( * ) Notice: Subject to any disclaimer, the term of this patent is extended or adjusted under 35 U.S.C. 154(b) by 113 days.

(21) Appl. No.: 16/354,068

(22) Filed: Mar. 14, 2019

(65) Prior Publication Data

US 2019/0291126 A1 Sep. 26, 2019

Related U.S. Application Data

(60) Provisional application No. 62/647,297, filed on Mar. 23, 2018.

(51) Int. Cl.
*B05B 15/16* (2018.01)
*B05B 15/74* (2018.01)
*B05B 15/656* (2018.01)

(52) U.S. Cl.
CPC ..... *B05B 15/16* (2018.02); *B05B 15/656* (2018.02); *B05B 15/74* (2018.02)

(58) Field of Classification Search
CPC ..... B05B 15/16; B05B 15/656; B05B 15/74
USPC ..... 239/203–206, 288–288.5
See application file for complete search history.

(56) References Cited

U.S. PATENT DOCUMENTS

| | | | | |
|---|---|---|---|---|
| 3,709,345 | A | 1/1973 | Price | |
| 3,709,435 | A * | 1/1973 | Sheets | B05B 15/74 239/206 |
| 3,762,642 | A | 10/1973 | Di Santo | |
| 3,904,832 | A | 9/1975 | Fallon | |
| 4,145,003 | A | 3/1979 | Harrison et al. | |
| 4,429,832 | A | 2/1984 | Sheets | |
| 5,137,307 | A | 8/1992 | Kinsey | |
| 5,253,952 | A | 10/1993 | Selway | |
| 5,992,760 | A | 11/1999 | Kearby et al. | |
| 6,439,476 | B1 | 8/2002 | Boggs | |
| 10,314,245 | B2 * | 6/2019 | Wright, III | A01G 20/00 |
| 2020/0056860 | A1 * | 2/2020 | Glaser | B44F 11/00 |

* cited by examiner

*Primary Examiner* — Steven J Ganey
(74) *Attorney, Agent, or Firm* — Inskeep IP Group, Inc.

(57) ABSTRACT

Described herein is a bounce-reducing cover assembly that is positioned on the top of the cover and riser of a sprinkler to achieve a similar golf ball bounce characteristic as typical golf course turf. The cover assembly has a top surface that is composed of a plurality of vertical fingers or posts, which help achieve the desired bounce characteristics with a golf ball. Specifically, these fingers are flexible and provide some "give" so as to absorb some of the force from an incoming golf ball. Depending on the durometer of the material, size of the fingers, and spacing of the fingers, different bounce characteristics can be achieved.

12 Claims, 12 Drawing Sheets

BOUNCE REDUCING COVER FOR A SPRINKLER

RELATED APPLICATIONS

This application claims priority to U.S. Provisional Application Ser. No. 62/647,297 filed Mar. 23, 2018 entitled Bounce Reducing Cover for a Sprinkler, which is hereby incorporated herein by reference in its entirety.

BACKGROUND OF THE INVENTION

Irrigation sprinklers are typically installed within the ground at numerous locations on golf courses such that they can deliver water to all areas of the course's turf. In this respect, golf courses may have dozens or even hundreds of sprinklers to provide adequate coverage of the turf.

Most sprinklers have covers or top surfaces composed of hard plastic. While such hard plastic is typically resistant to weather, course maintenance equipment, and other conditions encountered on a course, they provide a surface that is harder than the surrounding turf. Hence, when a golf ball strikes a sprinkler cover, it tends to bounce much higher and farther than it would if it only contacted the turf surrounding the sprinkler. This unexpected bounce characteristic can interfere with a player's performance and enjoyment of the game.

SUMMARY OF THE INVENTION

In one embodiment, the present invention is directed to a bounce-reducing cover assembly that is positioned on the top of the cover and riser of a sprinkler to achieve a similar golf ball bounce characteristic as typical golf course turf. The cover assembly includes a main portion that is positioned on the cover and a riser portion is also included on the cover of the riser.

Both the main portion and the riser portion have top surfaces that are composed of a plurality of vertical fingers or posts, which help achieve the desired bounce characteristics with a golf ball. Specifically, these fingers are flexible and provide some "give" so as to absorb some of the force from an incoming golf ball. Depending on the durometer of the material, size of the fingers, and spacing of the fingers, different bounce characteristics can be achieved.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
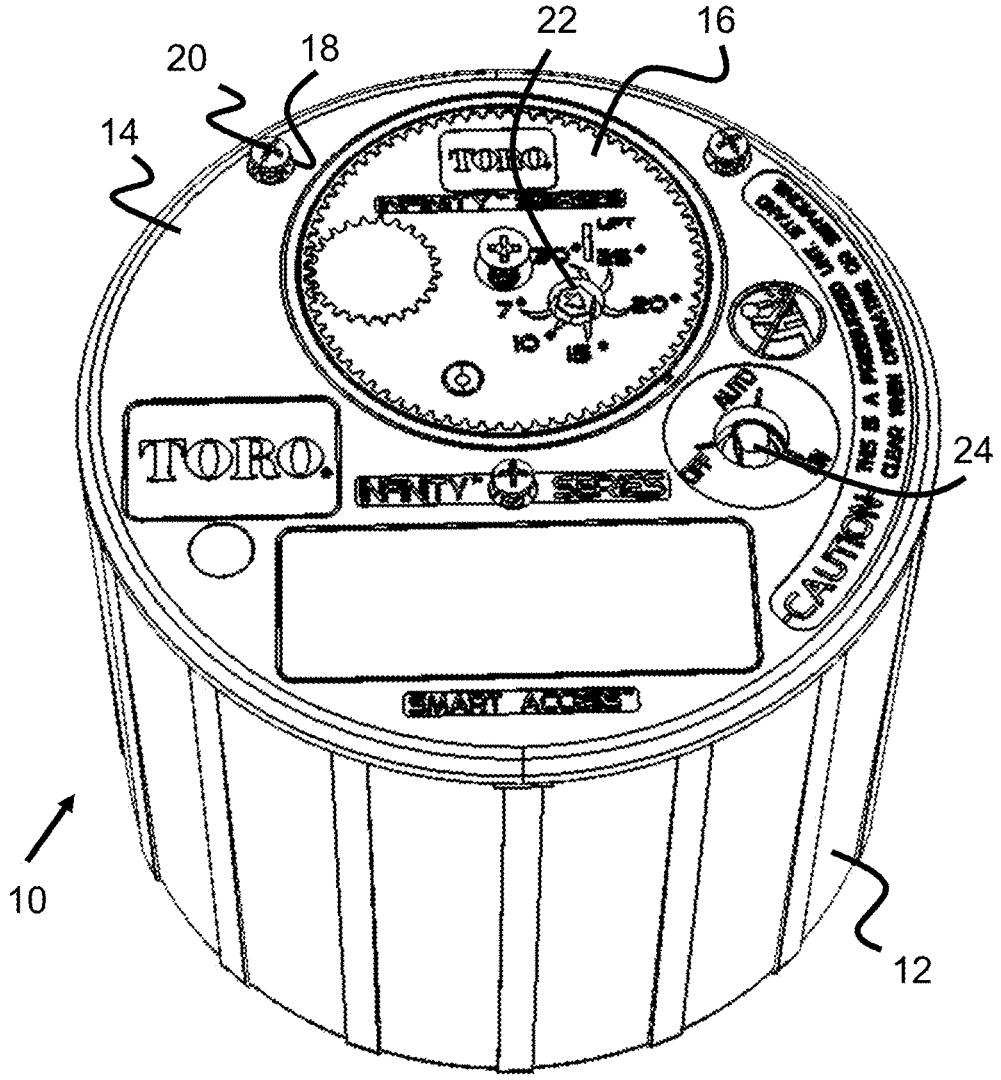
FIG. 1 is a top view of an irrigation sprinkler.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIG. 1 illustrates a sprinkler 10 that is generally similar to the sprinklers shown in U.S. Pat. Nos. 7,631,813 and 9,539,602; which are both incorporated herein by reference. The sprinkler 10 includes an outer wall 12 that forms a compartment with the top cover 14. A riser and its top cover 16 are positioned within that compartment in a radially-offset orientation. The sprinkler 10 also includes a pilot valve control knob 24 for manually turning on/off irrigation, as well as a trajectory angle adjustment control knob 22. Since this style sprinkler 10 has a relatively large upper surface area due to its internal compartment, a player may be more likely to encounter this sprinkler 10 during a game. However, it should be understood that the present invention can be used with any style irrigation sprinkler having a top cover that lowers to a position that is generally level with the ground (e.g., compartment cover, riser cover, and/or surrounding flange).

Figure 2:
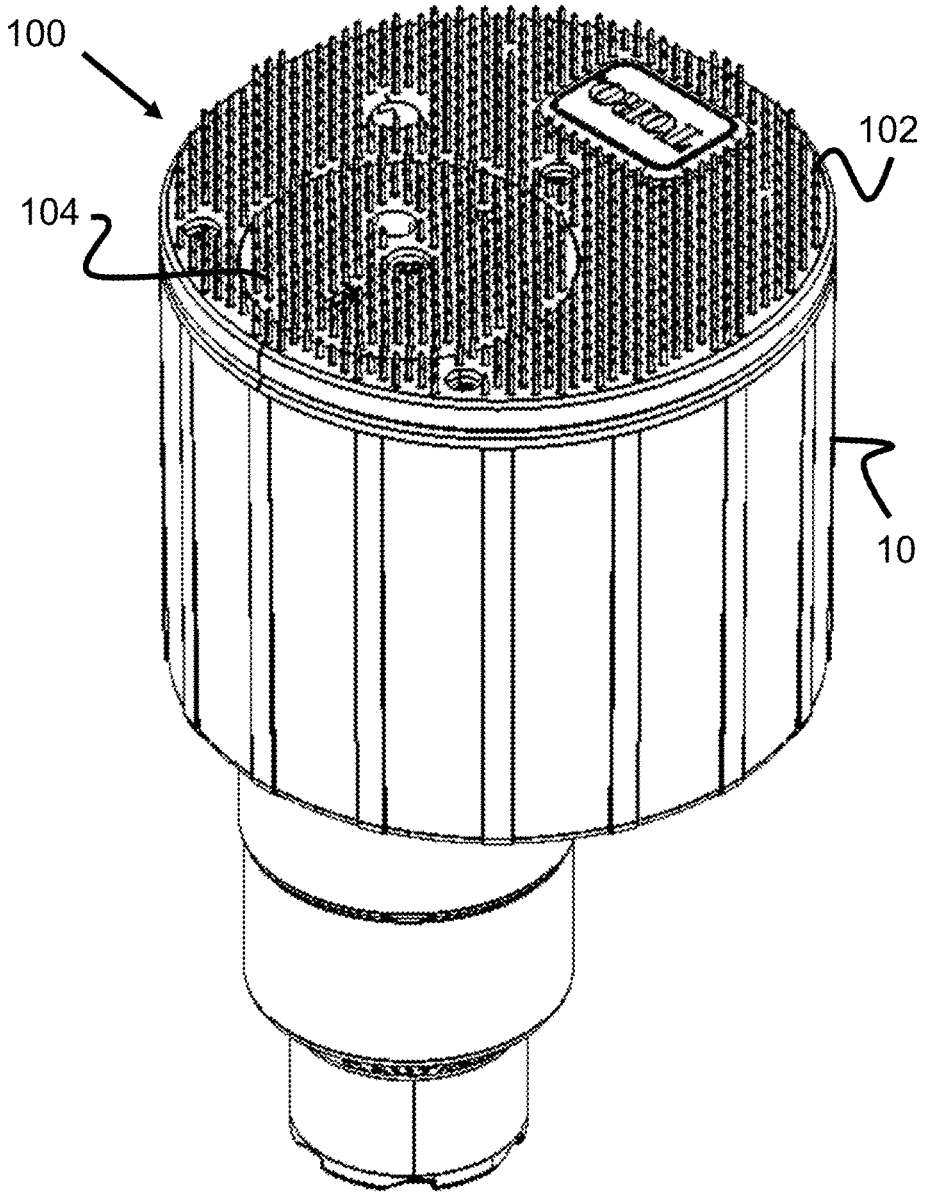
FIG. 2 is a top view of an irrigation sprinkler with a bounce-reducing cover assembly.
Figure 3:
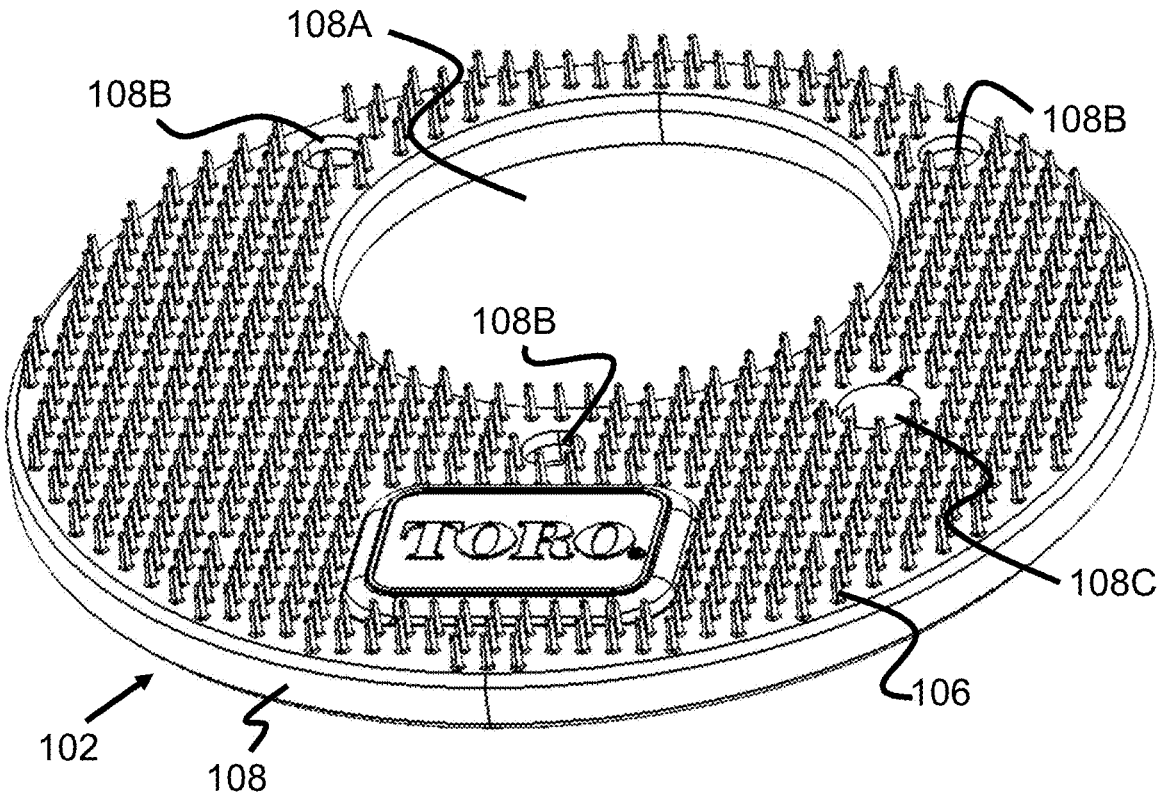
FIG. 3 is a top view of a bounce-reducing cover assembly.
Figure 14:
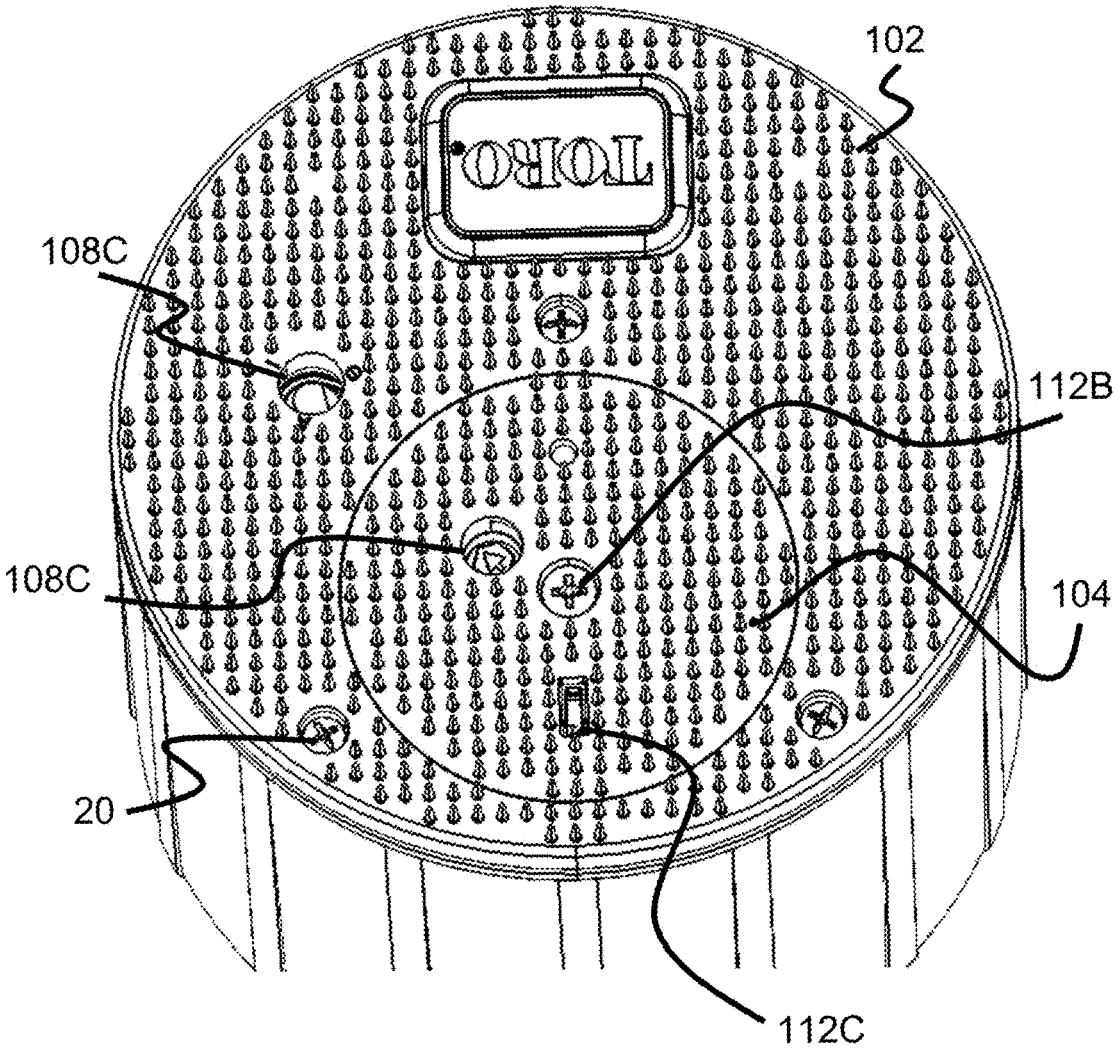
FIG. 14 illustrates a top view of the installed bounce-reducing cover assembly.

FIGS. 2 and 14 illustrate a bounce-reducing cover assembly 100 that is positioned on the top of the cover 14 and riser 16 to achieve a similar golf ball bounce characteristic as typical golf course turf. The cover assembly 100 includes a main portion 102 that is positioned on the cover 14 and is seen best in FIGS. 3-7. A riser portion 104 is also included on the cover 16 of the riser and is seen best in FIGS. 8-11. While the example sprinkler 10 is not illustrated with a surrounding top flange, it is contemplated that the bounce-reducing cover assembly 100 may also be adapted to cover such a flange or may be integrated into a replacement flange.

Figure 4:
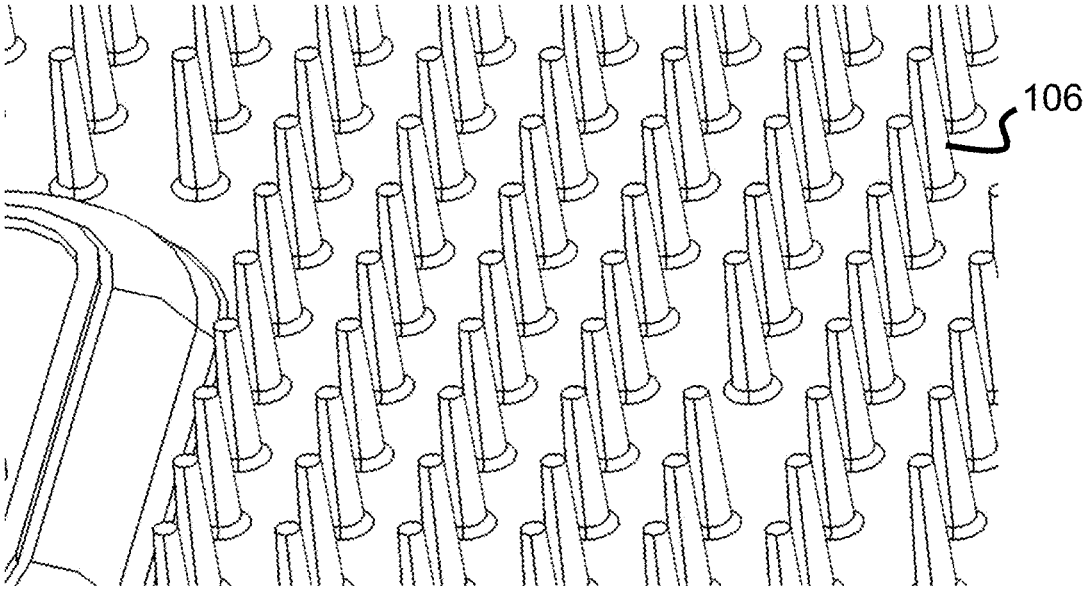
FIG. 4 is a magnified view of a bounce-reducing cover assembly.
Figure 5:
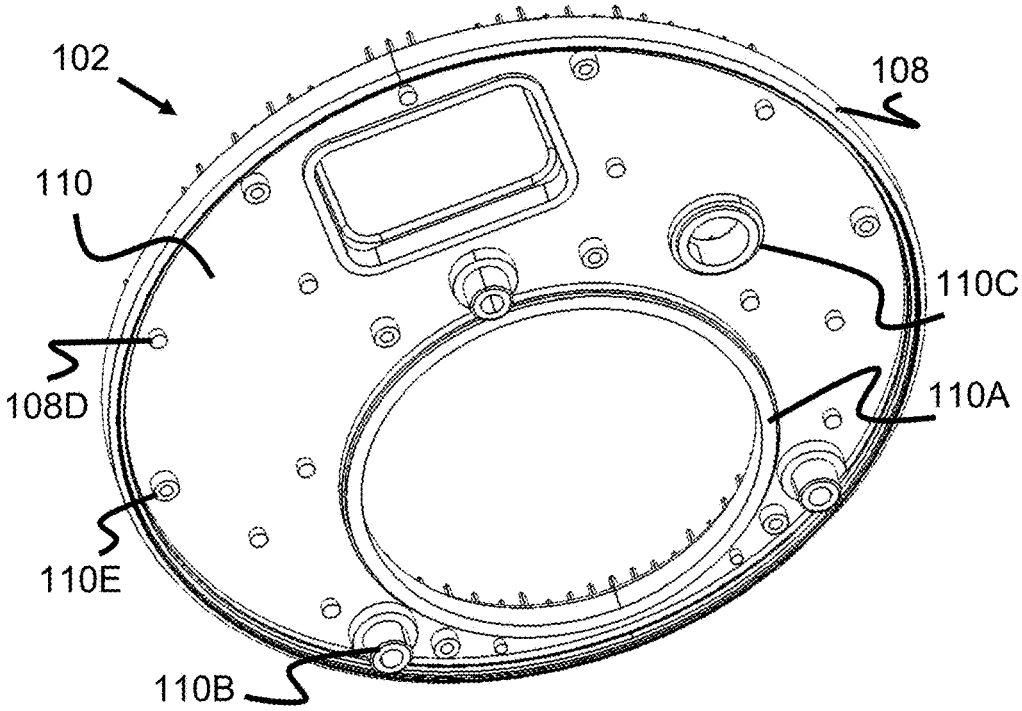
FIG. 5 is a bottom view of an irrigation sprinkler with a bounce-reducing cover assembly.
Figure 6:
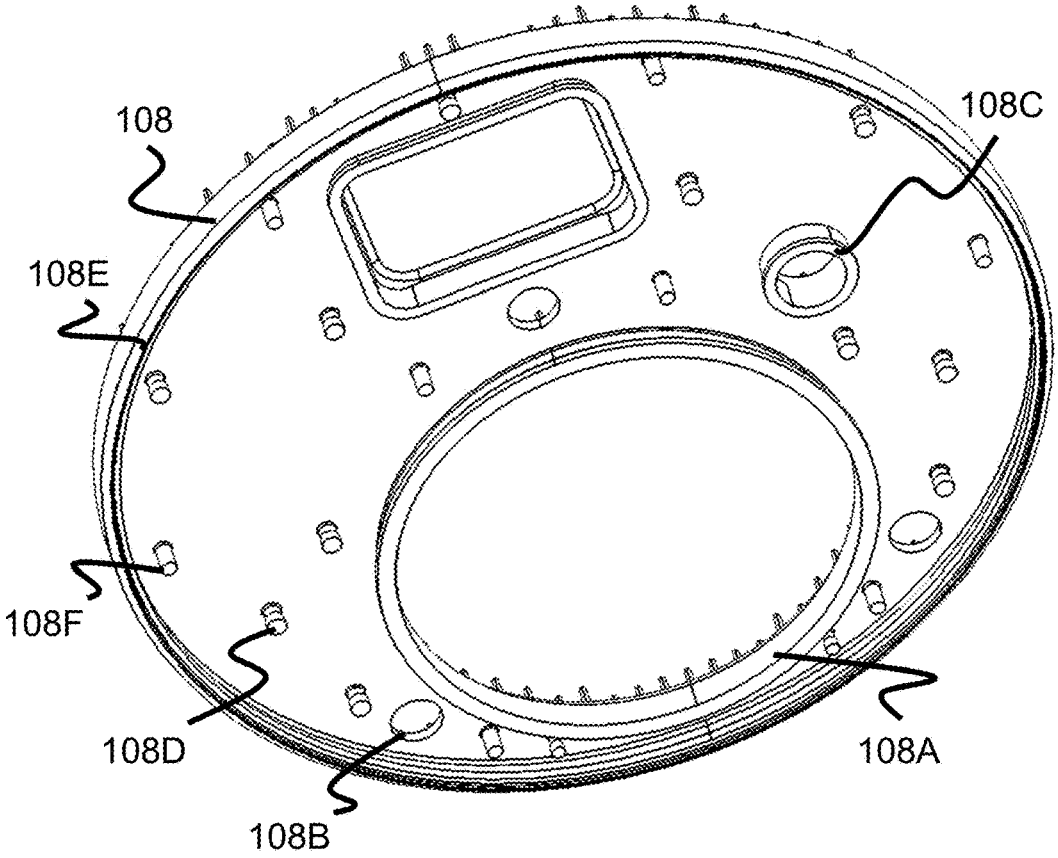
FIG. 6 is a flexible layer of a bounce-reducing cover assembly.
Figure 7:
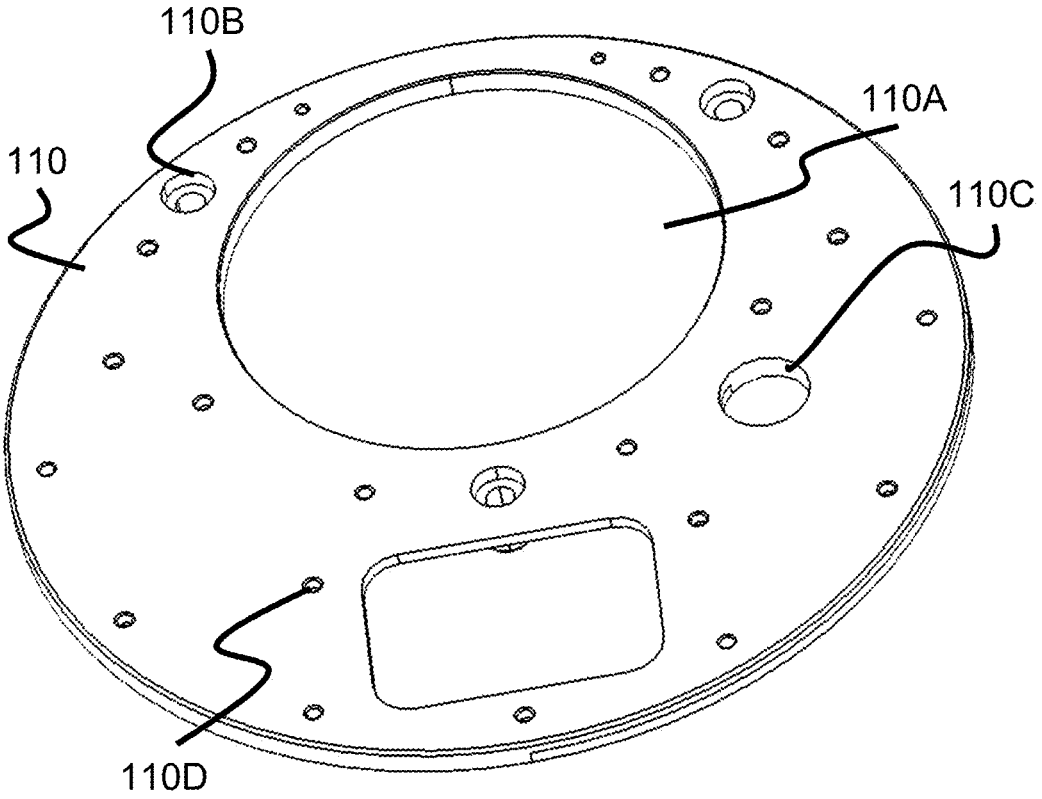
FIG. 7 is a rigid layer of a bounce-reducing cover assembly.
Figure 8:
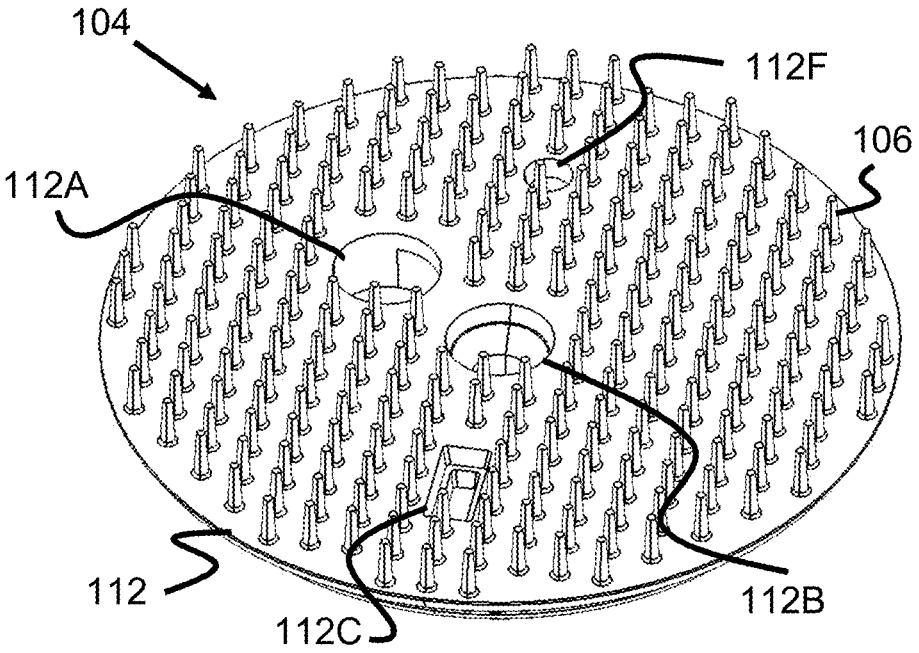
FIG. 8 a top view of a riser portion of a bounce-reducing cover assembly.

Both the main portion 102 and the riser portion 104 have top surfaces (e.g., of the flexible layers) that are composed of a plurality of vertical fingers or posts 106, seen best in FIG. 4, which help achieve the desired bounce characteristics with a golf ball. Specifically, these fingers 106 are flexible and provide some "give" so as to absorb some of the force from an incoming golf ball. Depending on the durometer of the material, size of the fingers 106, and spacing of the fingers, different bounce characteristics can be achieved. In one preferred embodiment, the posts 106 are about 0.635 cm in height, about 0.165 cm in diameter at their bottom, about 0.102 cm in diameter at their top, and are spaced at about 0.508 cm from each other. In another embodiment, the posts 106 have a height in a range of about 0.3 cm to 3 cm, have a bottom diameter in a range of about 0.01 cm to 1 cm, have a top diameter in a range of about 0.01 cm to 1 cm, and are spaced apart in a range of about 0.05 cm to 1 cm.

Figure 13:
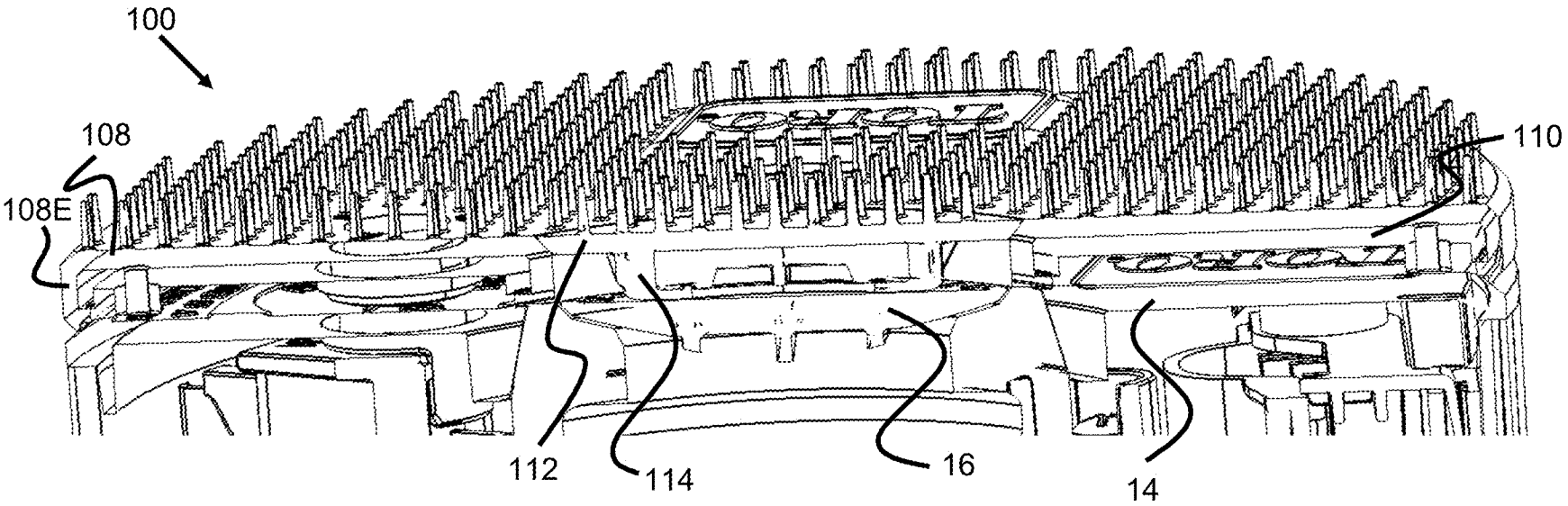
FIG. 13 illustrates a cross sectional view of the bounce-reducing cover assembly.
Figure 15:
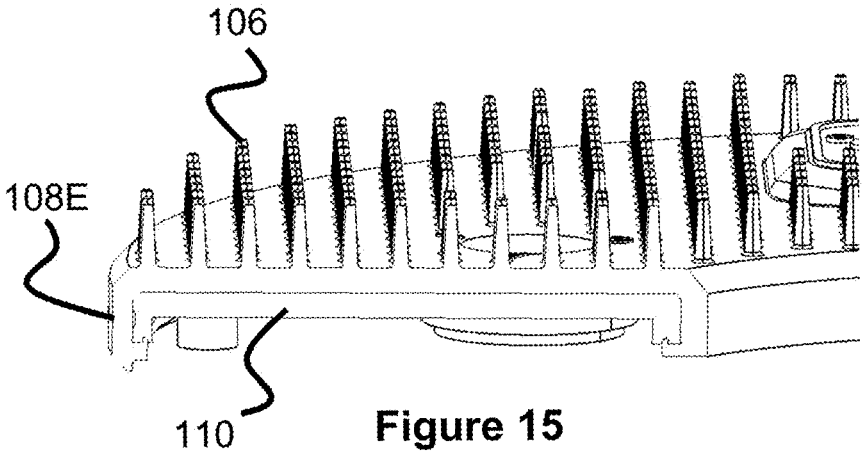
FIG. 15 illustrates a cross sectional view of the bounce-reducing cover assembly.

The main portion 102 is composed of a rigid layer 114 (FIGS. 5 and 7) and of a resilient or flexible layer 108 (FIG. 6) that is disposed on top of the rigid layer 110. In one embodiment, the flexible layer 108 is composed of thermoplastic polyurethane (TPU) elastomer with durometer of 82 Shore A and the rigid layer 110 is composed of acrylonitrile butadiene styrene (ABS). The flexible layer 108 includes a plurality of cylindrical posts or legs 108D extending from its bottom surface that are sized and positioned to pass through the smaller apertures 110D of the rigid layer 110, helping to retain the position of the layer 108. Additionally, these posts help support the rigid layer 110, in addition to the legs/posts 108F. The flexible layer 108 is further retained by an outer lip or ridge 108E that is positioned over the edges of the rigid layer 110, as best seen in FIGS. 13 and 15.

Figure 17:
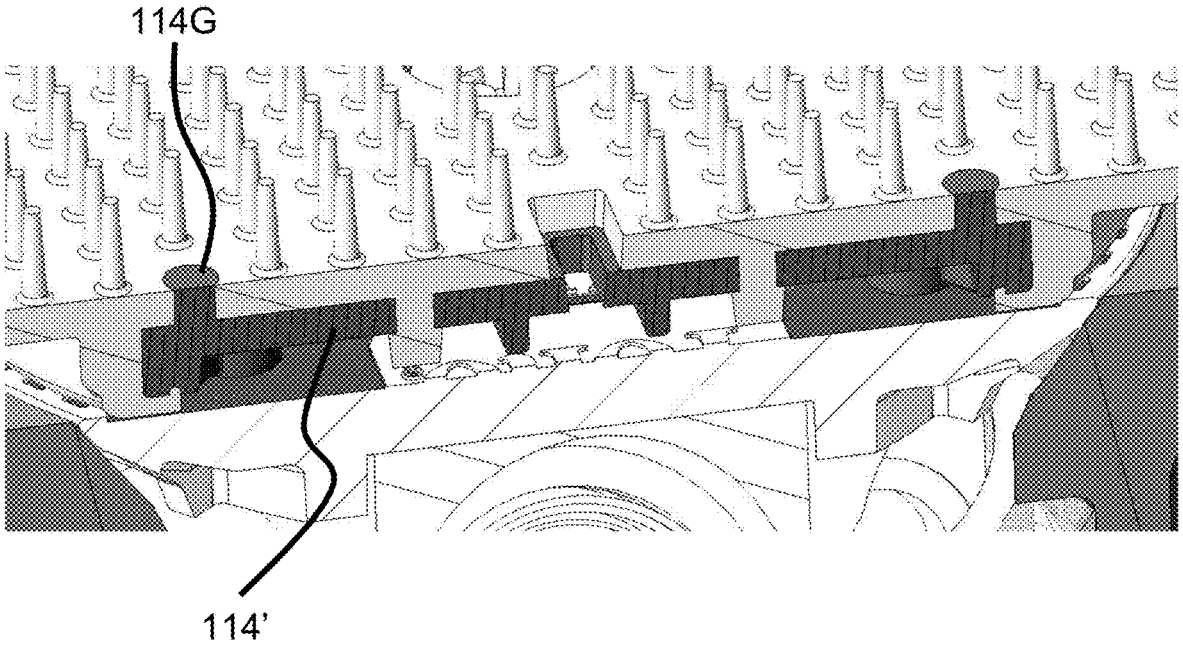
FIG. 17 illustrates a cross sectional view of the bounce-reducing cover assembly.

In one preferred embodiment, the flexible layer 108 is injection molded or over-molded onto the previously molded rigid layer 110. In this embodiment the posts or legs 108D and the mating portions of the flexible layer 108 are formed by the boundary of the rigid layer 110. This embodiment lends to easier manufacture of the flexible layer because the 2 layers, now a semi-rigid assembly after molding, can then be ejected from the molding machine easier than the flexible layer could be ejected by itself. Ejecting the flexible layer by itself would be difficult due to the elastomeric properties and tendency of the 106 fingers to stick to the steel of the mold making conventional ejection techniques unreliable or more complex than ejection of a rigid part. This manufacturing method also eliminates the need to secure the flexible layer to the rigid layer after molding which would be difficult to do without using additional fasteners or complicated assembly fixtures. A separate flexible layer to rigid layer assembly operation would also have more potential for damage to the vertical fingers 106 or require finger removal to provide clearance for additional fasteners or assembly fixture contact. As seen in FIG. 17, it may also be desirable for the rigid layer (e.g., 114') to include vertical posts 114G that extend upwards, creating apertures in the flexible layer. These posts 114G may help maintain the flexible layer in place during the molding process and prevent elastomeric resin leakage/flash on the opposite side as the elastomeric resin fills the over-mold cavity.

The main portion 102 further includes a plurality of apertures that align over features of the sprinkler 10 to allow otherwise normal sprinkler behavior and access. For example, the riser aperture formed from openings 108A and 110A is sized to allow the riser to extend up through it during irrigation. In another example, apertures 108C and 110C expose the pilot valve control knob 24, and apertures 108B and 1106 align to expose screw holes 18 into which screws 20 pass into to retain the assembly 100 to the sprinkler 10.

The riser portion 104 (FIGS. 8-11) is similar to the main portion 102 in that it includes a rigid layer 114 and a flexible layer 112 that is positioned on top of the rigid layer 114. Like the main portion, the underside of the flexible layer 112 has a plurality of legs or posts 112E that are sized and positioned to pass through the smaller apertures 114E of the rigid layer 114, as well as legs/posts 112E on the underside of the rigid layer 114. Also, the flexible layer 112 includes an outer lip or ridge 112D that engages around the outer edge of the rigid layer 114. The preferred embodiment of the riser portion 104 rigid layer 114 and flexible layer 112 manufacturing and assembly methods would be over-molding the flexible layer onto the rigid layer for similar reasons to the main portion 102.

Figure 9:
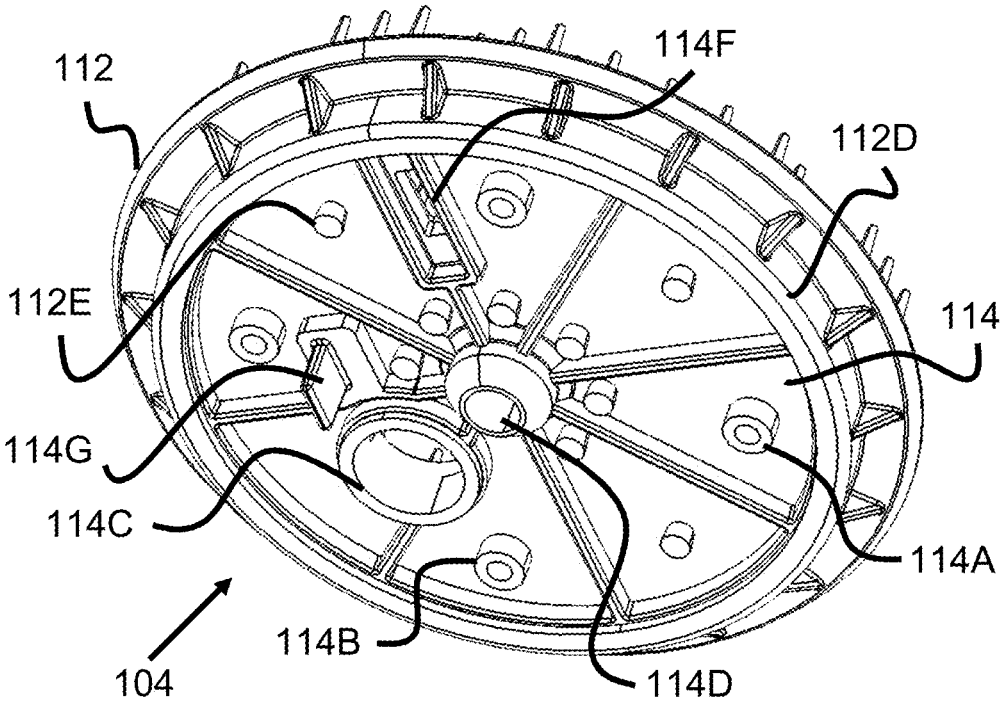
FIG. 9 is a bottom view of a riser portion of a bounce-reducing cover assembly.
Figure 10:
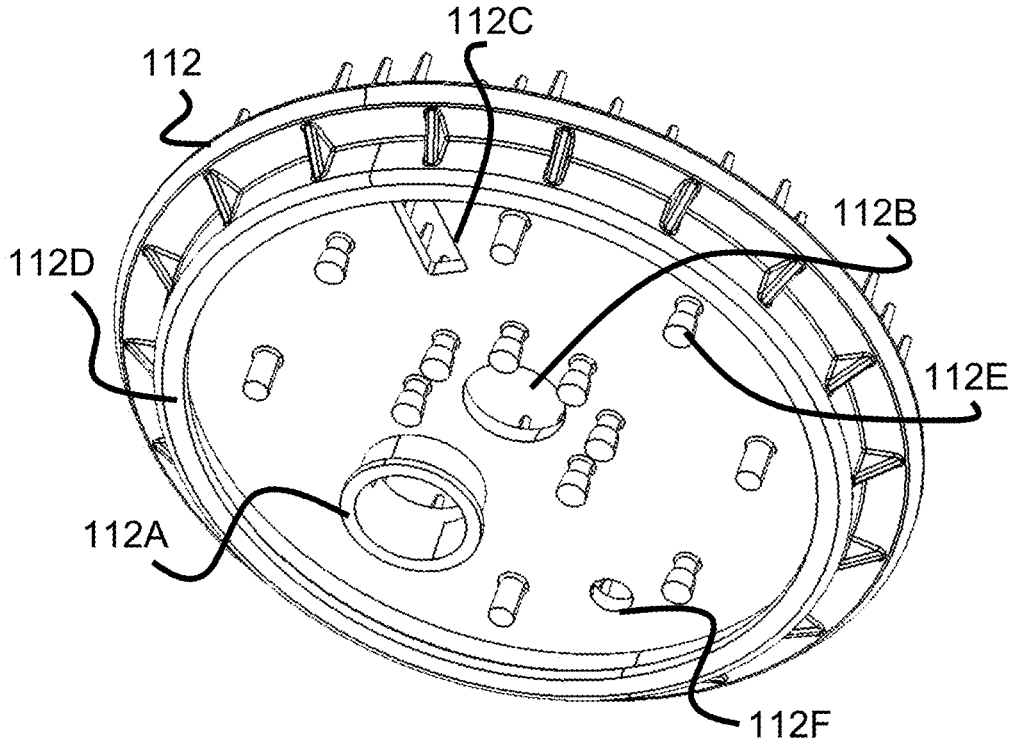
FIG. 10 is a bottom view of a flexible layer of a riser portion of a bounce-reducing cover assembly.
Figure 11:
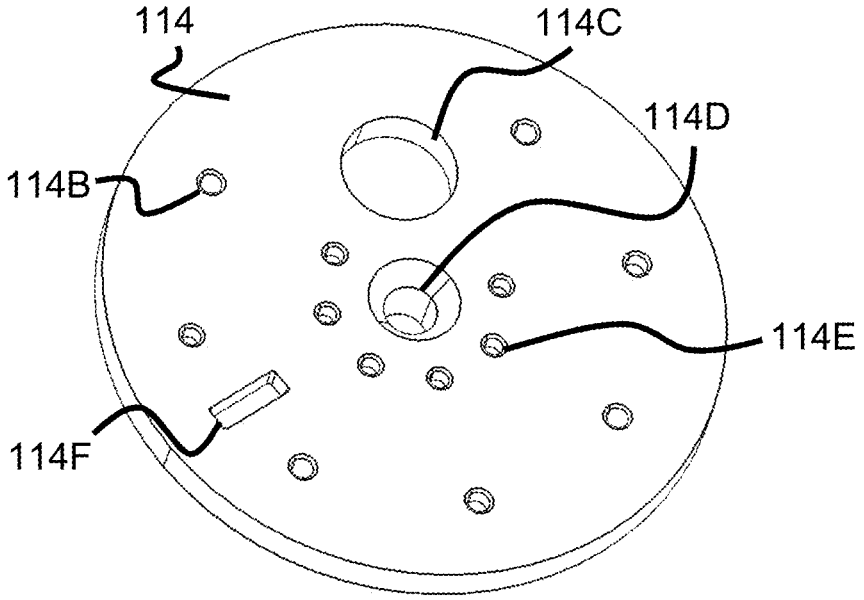
FIG. 11 is a rigid layer of a riser portion of a bounce-reducing cover assembly.
Figure 12:
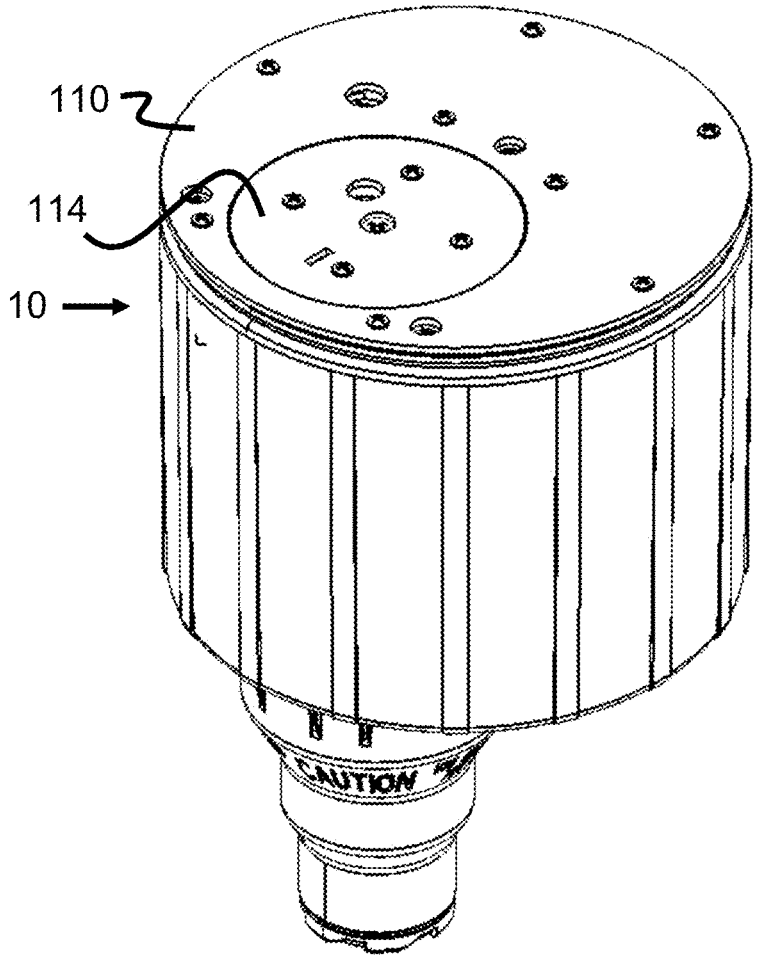
FIG. 12 illustrates a sprinkler with only the rigid portions of the bounce-reducing cover assembly installed.

Apertures 112B and 114D align to expose a screw hole 18 in the cover 16 of the riser, allowing the riser portion 104 and the cover 16 to be secured to the riser. Apertures 112A and 114C align to expose the trajectory angle control knob 22, allowing adjustment of the watering trajectory without the need to first remove the riser portion 104. Slot 112C and 114F align to create an area in which the user can lift the riser with a tool when irrigation is not being performed (e.g., to adjust the watering arc of the riser). Slot 112C and 114F may align with a similar slot in the riser cover 16, or may be located at a different position (a leg 114G can be further included to extend into the original slot on the cover 16, as seen in FIG. 9).

It is contemplated that different flexible layers 108, 112 can be provided with different bounce characteristics (e.g., together as a single kit or sold separately). For example, if a sprinkler 10 is located in the rough or fairway of a course where the turf is relatively tall, a softer material and/or longer fingers 106 can be used. If a sprinkler is in an area with relatively short turf, such as the green, shorter fingers 106 can be used.

Figure 16:
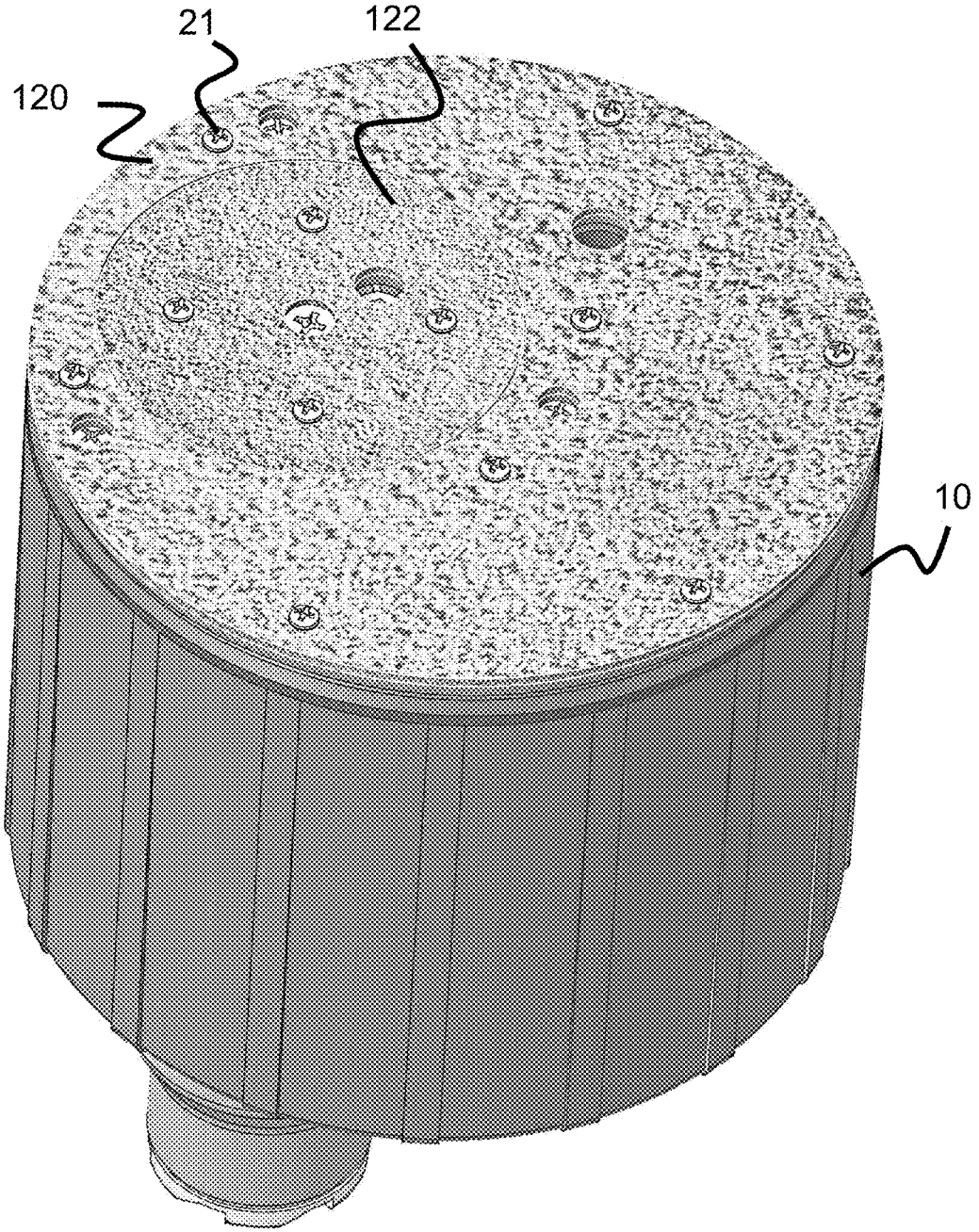
FIG. 16 illustrates a top view of the bounce-reducing cover assembly with artificial turf.

Optionally, the entire flexible layers 108, 112 can be removed and replaced with main portions 120 and riser portions 122 of artificial turf for some areas, as seen in FIG. 16. Since artificial turf does not necessarily have any lower posts, lips, or other retaining means, the apertures 110D and 114E of the rigid portions 110 and 114 can be used to accept retaining screws 21 that maintain the turfs position. In another embodiment, the artificial turf can be further attached over the flexible layers 108, 112 to provide enhanced bounce reduction that may not otherwise be provided by artificial turf alone.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A bounce-reducing cover assembly for an irrigation sprinkler, comprising:

a rigid layer shaped to cover and removably attach to a top surface of an irrigation sprinkler; the top surface of the irrigation sprinkler including a cover of a riser and a cover of a top sprinkler compartment; and, a flexible layer engaged with said rigid layer;

wherein said bounce-reducing cover assembly, including said rigid layer and said flexible layer, comprises a first portion configured to connect to the cover of the riser and a second portion configured to connect to the cover of the top sprinkler compartment.

2. The bounce-reducing cover assembly of claim 1, wherein a top surface of said flexible layer comprises a plurality of vertical posts.

3. The bounce-reducing cover assembly of claim 2, wherein said plurality of vertical posts have a height in a range of 0.3 cm to 3 cm, have a bottom diameter in a range of 0.01 cm to 1 cm, have a top diameter in a range of 0.01 cm to 1 cm, and are spaced apart in a range of 0.05 cm to 1 cm.

4. The bounce-reducing cover assembly of claim 2, wherein said plurality of vertical posts are about 0.635 cm in height, about 0.165 cm in diameter at their bottom, about 0.102 cm in diameter at their top, and are spaced at about 0.508 cm from each other.

5. A bounce-reducing cover assembly for an irrigation sprinkler, comprising:

a rigid layer shaped to cover and removably attach to a top surface of an irrigation sprinkler; the top surface of the irrigation sprinkler including a riser cover; and, a flexible layer engaged with said rigid layer;

wherein said flexible layer comprises a bottom surface have a plurality of cylindrical posts positioned through apertures of said rigid layer.

6. A bounce-reducing cover assembly for an irrigation sprinkler, comprising:

a rigid layer shaped to cover and removably attach to a top surface of an irrigation sprinkler; the top surface of the irrigation sprinkler including a riser cover; and, a flexible layer engaged with said rigid layer;

wherein said flexible layer further comprises an outer lip that is positioned over the outer edges of said rigid layer, so as to help retain said flexible layer with said rigid layer.

7. A bounce-reducing cover assembly for an irrigation sprinkler, comprising:

a rigid layer shaped to cover and removably attach to a top surface of an irrigation sprinkler; the top surface of the irrigation sprinkler including a riser cover; and, a flexible layer engaged with said rigid layer;

wherein said rigid layer and said flexible layer has one or more aligned apertures that expose one or more sprinkler controls located on said top surface of said irrigation sprinkler.

8. A bounce-reducing cover assembly for an irrigation sprinkler, comprising:

a flexible layer shaped to cover and removably attach to a top surface of an irrigation sprinkler; said flexible layer having a top surface comprising a plurality of vertical posts;

wherein said plurality of vertical posts have a height in a range of 0.3 cm to 3 cm, have a bottom diameter in a range of 0.01 cm to 1 cm, have a top diameter in a range of 0.01 cm to 1 cm, and are spaced apart in a range of 0.05 cm to 1 cm.

9. The bounce-reducing cover assembly of claim 8, wherein said plurality of vertical posts are about 0.635 cm in height, about 0.165 cm in diameter at their bottom, about 0.102 cm in diameter at their top, and are spaced at about 0.508 cm from each other.

10. The bounce-reducing cover assembly of claim 8, further comprising a rigid layer connected to said flexible layer; said rigid layer shaped and configured to removably engage said top surface of said irrigation sprinkler.

11. A bounce-reducing cover assembly for an irrigation sprinkler, comprising:

a flexible layer shaped to cover and removably attach to a top surface of an irrigation sprinkler; said flexible layer having a top surface comprising a plurality of vertical posts;

a rigid layer connected to said flexible layer; said rigid layer shaped and configured to removably engage said top surface of said irrigation sprinkler;

wherein said flexible layer further comprises an outer lip that is positioned over the outer edges of said rigid layer, so as to help retain said flexible layer with said rigid layer.

12. A bounce-reducing cover assembly for an irrigation sprinkler, comprising:

a flexible layer shaped to cover and removably attach to a top surface of an irrigation sprinkler; said flexible layer having a top surface comprising a plurality of vertical posts;

a rigid layer connected to said flexible layer; said rigid layer shaped and configured to removably engage said top surface of said irrigation sprinkler;

wherein said rigid layer and said flexible layer has one or more aligned apertures that expose one or more sprinkler controls located on said top surface of said irrigation sprinkler.

* * * * *